United States Patent [19]

Gittinger et al.

[11] Patent Number: 4,475,111

[45] Date of Patent: Oct. 2, 1984

[54] PORTABLE COLLAPSING ANTENNA

[75] Inventors: Norman C. Gittinger; Richard L. Frey; James R. Lewis, all of Schenectady, N.Y.

[73] Assignee: General Electric Company, Schenectady, N.Y.

[21] Appl. No.: 349,278

[22] Filed: Feb. 16, 1982

[51] Int. Cl.[3] ..... H01Q 1/36; H01Q 1/08

[52] U.S. Cl. ..... 343/881; 343/895; 343/915

[58] Field of Search ..... 343/DIG. 2, 702, 868, 343/880, 881, 895, 915, 916

[56] References Cited

U.S. PATENT DOCUMENTS

| | | | |
|---|---|---|---|
| 2,413,558 | 12/1946 | Goddard | 343/916 |
| 3,553,732 | 1/1971 | Glynn | 343/840 |
| 3,836,979 | 9/1974 | Kurland et al. | 343/895 |
| 4,152,708 | 5/1979 | Boucher | 343/880 |

*Primary Examiner*—Eli Lieberman

*Attorney, Agent, or Firm*—Geoffrey H. Krauss; James C. Davis, Jr.; Marvin Snyder

[57] ABSTRACT

A one-piece, collapsible, readily-portable and rapidly-erectable antenna includes a substantially-planar and electrically-conductive ground plane consisting essentially of a central base element and a plurality of electrically conductive assemblies uniformly spaced about and mounted on the base element, the assemblies being guided on telescoping support rods for movement between expanded and collapsed positions relative to the base assembly. An at-least-three-sided elongated frame structure has a first end mounted on the base element; the other end is movable toward and away from the base element between collapsed and expanded frame structure positions, to collapsibly support a conductive radiator portion, comprising a metal helix. The helix is extended when the frame structure is expanded and is retracted when the frame structure is collapsed. A plurality of elongated rods are mounted on the frame structure for generally radial slidable movement of at least one end portion of each rod toward and away from the frame structure as the frame structure moves between expanded and collapsed positions.

25 Claims, 10 Drawing Figures

8
10
18
22
34
36
38
42
44
48
52
54
56
58a
60a
62a
64
66
68
70
70a
72
72a
74
76
78

Fig. 9
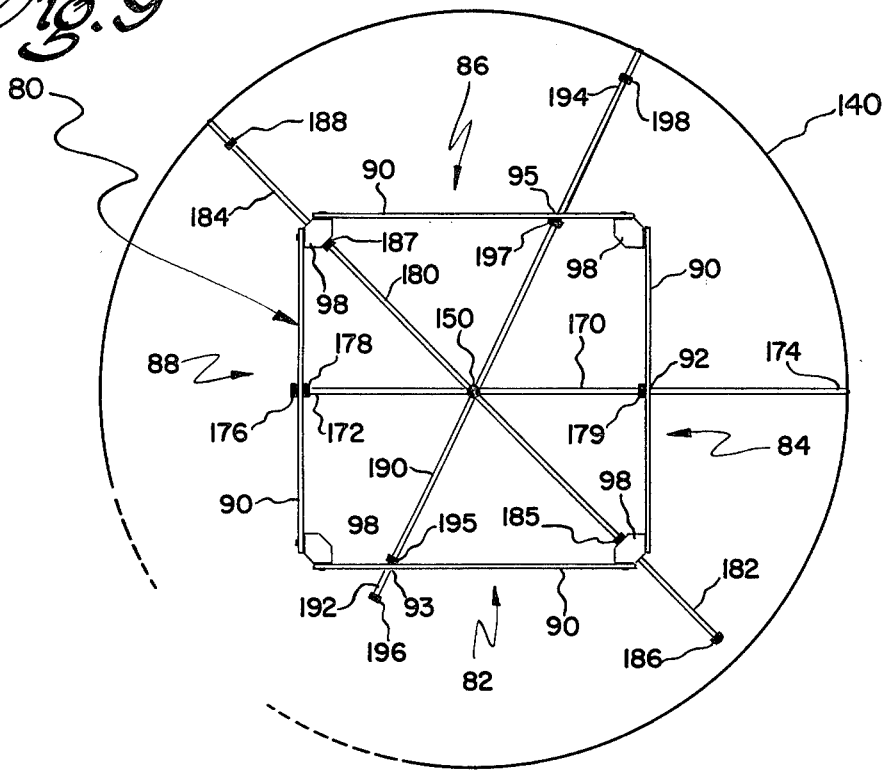
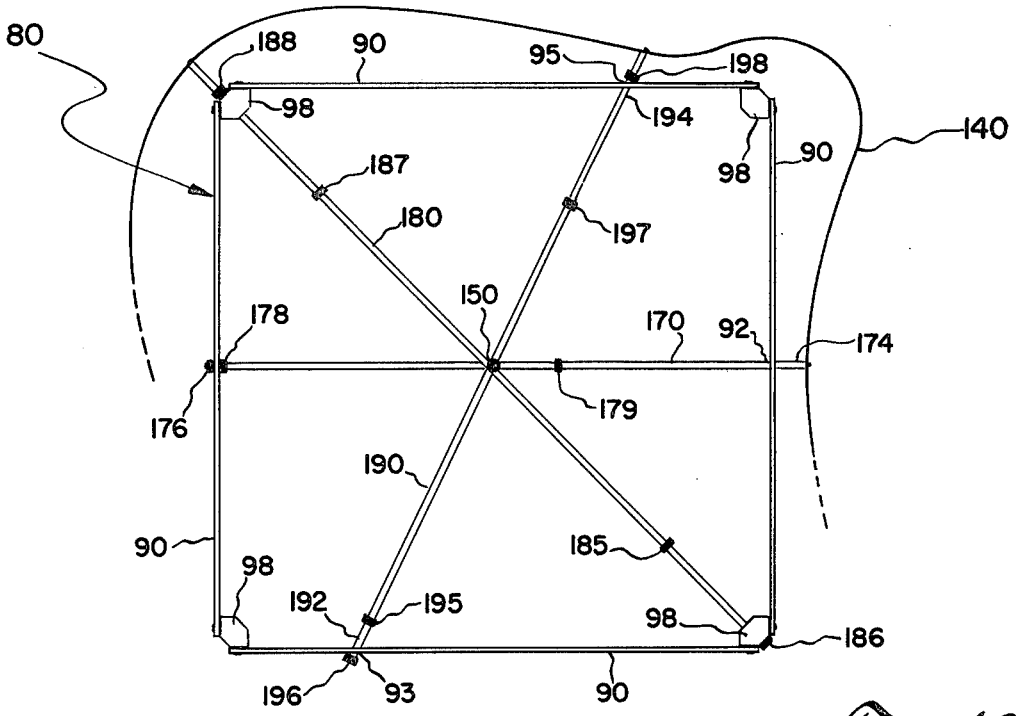
Fig. 10

PORTABLE COLLAPSING ANTENNA

BACKGROUND OF THE INVENTION

1. Field of the Invention

The present invention relates to portable antennas and, more particularly, to such antennas which are lightweight, readily collapsible and rapidly erectable.

2. Description of the Prior Art

Antennas for VHF transmission and reception are, of course, well known in terms of electrical design and, in recent years, have found considerable utility in applications involving communications with earth orbiting satellites. These antennas have typically been physically large and structurally cumbersome and totally unsuited for convenient and rapid relocation from site to site. Those antennas which could be transported have generally required dismantling at the old site, vehicular transportation in the dismantled condition, and then assembly at the new site. Such transportability is, of course, not the same as convenient portability and rapid erectability; a need currently exists for a truly portable antenna which can serve as a field-deployable portable satellite data terminal.

SUMMARY OF THE INVENTION

It is, therefore, an object of the invention to provide a field-deployable portable antenna which is lightweight and collapsible to a size which can be accommodated within a compact package.

It is another object of the invention to provide a portable antenna which is one piece when collapsed or erected and, therefore, which includes no loose parts and requires neither assembly nor disassembly.

It is still another object of the invention to provide a portable antenna which can be readily transported, by an average-sized person, to a desired transmission or reception site and erected in just a few minutes.

It is yet another object of the invention to provide a one-piece, collapsible, lightweight, portable and rapidly-erectable satellite communications antenna using a directional, circularly-polarized helix exhibiting 6 dB minimum gain and a considerable bandwidth.

Other objects and advantages will become apparent from the following description and appended claims considered together with the accompanying drawings.

BRIEF DESCRIPTION OF THE INVENTION

In accordance with the invention, an antenna, particularly suited for radio transmission to and reception from satellites, is a one-piece, lightweight unit, collapsible to a size which can be accommodated within a conventional suitcase, can be readily portable, i.e., hand carryable by an average-sized person, and rapidly erectable within a few minutes. Preferably, the antenna is a directional, circularly-polarized helix which, when erected, exhibits a 6 dB minimum gain and a considerable bandwidth.

The antenna of the present invention is a unitary structure which generally comprises: a substantially planar, electrically-conductive first portion; a generally elongatible, electrically-conductive radiator second portion retractably extending substantially normal to the plane of the planar conductive portion; and means for collapsibly supporting the conductive radiator portion of the planar conductive portion. The conductive planar portion desirably includes an electrically-conductive base element having at least one electrically-conductive assembly collapsibly-mounted thereon. In one embodiment, the conductive planar portion includes a square base element and four identical assemblies uniformly spaced adjacent to each associated side of the base element and electrically connected to each adjacent assembly, each assembly comprising an electrically-conductive perimeter element affixed to a plurality of elongated electrically-conductive telescoping support rods for guided movement between a collapsed position wherein the perimeter defining elements are adjacent the sides of the base element and an expanded position wherein the perimeter-defining elements are spaced from the base element sides.

Desirably, the conductive radiator element is a flexible helix element spirally wound around the means for collapsibly supporting the helix on the conductive planar portion. The means for collapsibly supporting the helix includes an at least three-sided, and preferably four-sided, frame structure having one end remote from and movable toward and away from the conductive planar portion between collapsed and expanded frame structure positions, means mounting the other end of the frame structure positions, means mounting the other end of the frame structure to the conductive planar portion, and means mounting the helix to the frame structure for extending the helix when the frame structure is expanded and for retracting the helix when the frame structure is collapsed. In a preferred form of the invention, the frame sides comprise a plurality of pivotally-interconnected, relatively-movable frame sections. The frame sections comprise a pair of pivotally-interconnected, relatively-movable frame members, whereby movement of the remote end of the frame structure toward and away from the conductive planar element causes accordion-like collapse and expansion of the frame structure. The means mounting the helix to the frame structure desirably includes a plurality of elongated rods mounted on the frame structure, with one end portion of each rod projecting outwardly from the perimeter of the frame structure and affixed to the helix and the one end portion of each rod being slidable away from and toward the frame structure for extending and retracting the helix as the frame structure expands and collapses.

BRIEF DESCRIPTION OF THE DRAWINGS

FIG. 9 is an end view of the expandable center post of the antenna illustrating the helix and helix support system in an expanded helix configuration.

FIG. 10 is an end view of the expandable center post of the antenna illustrating the helix and helix support system in a collapsed helix configuration.

DETAILED DESCRIPTION OF THE INVENTION

Figure 5:
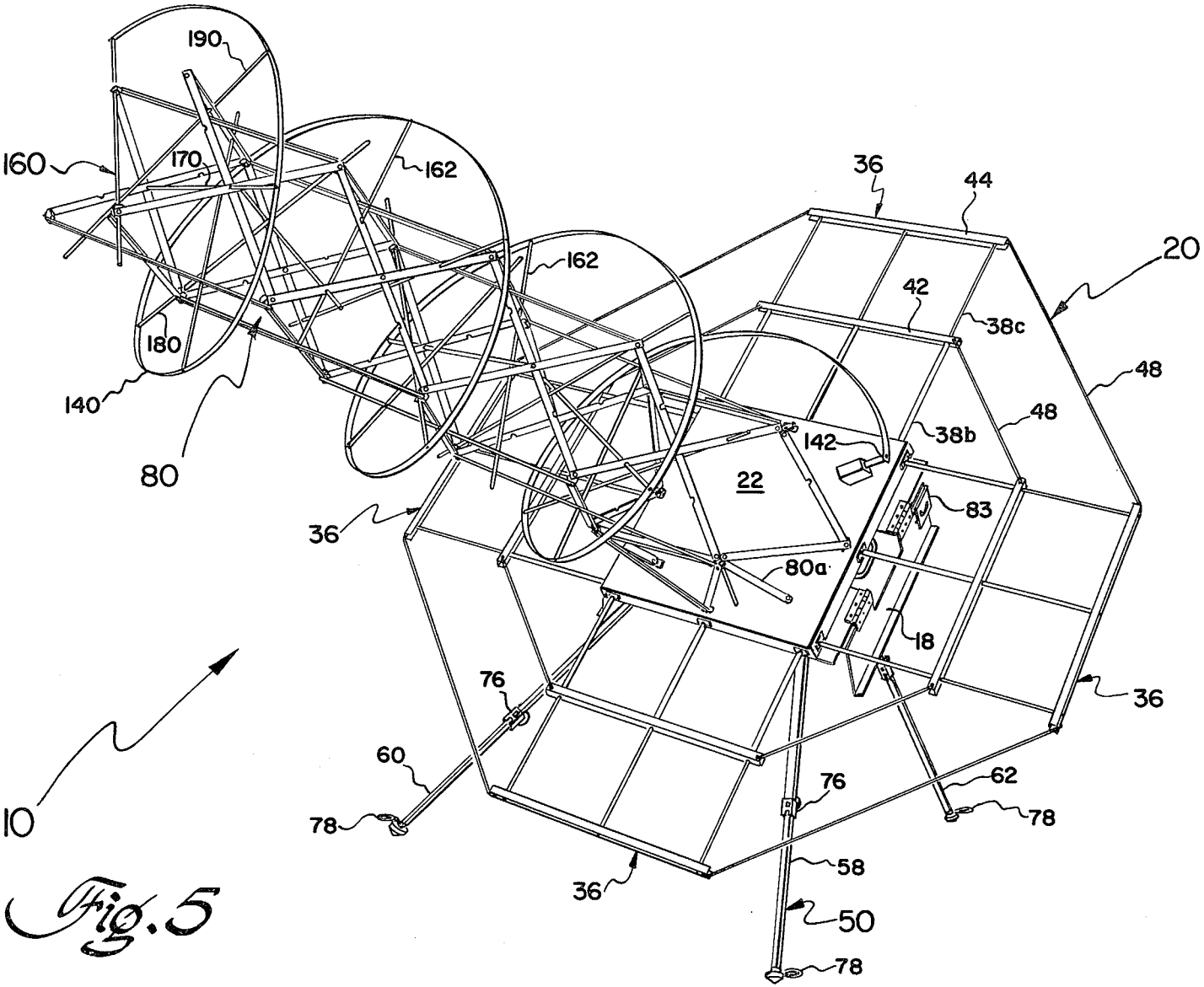
FIG. 5 is a perspective view of the antenna of the present invention in its fully unfolded and erected configuration.

The portable, collapsible antenna of the present invention, particularly well suited for VHF transmission to and reception from earth-orbiting satellites, is illustrated in its fully unfolded and erected configuration in FIG. 5. As can be seen most clearly from FIG. 5, antenna 10 consists essentially of an antenna ground plane 20, which is directly mounted upon and supported by an antenna support structure 50 and which in turn supports an expandable center post 80, helix 140 and helix support system 160.

Figure 6:
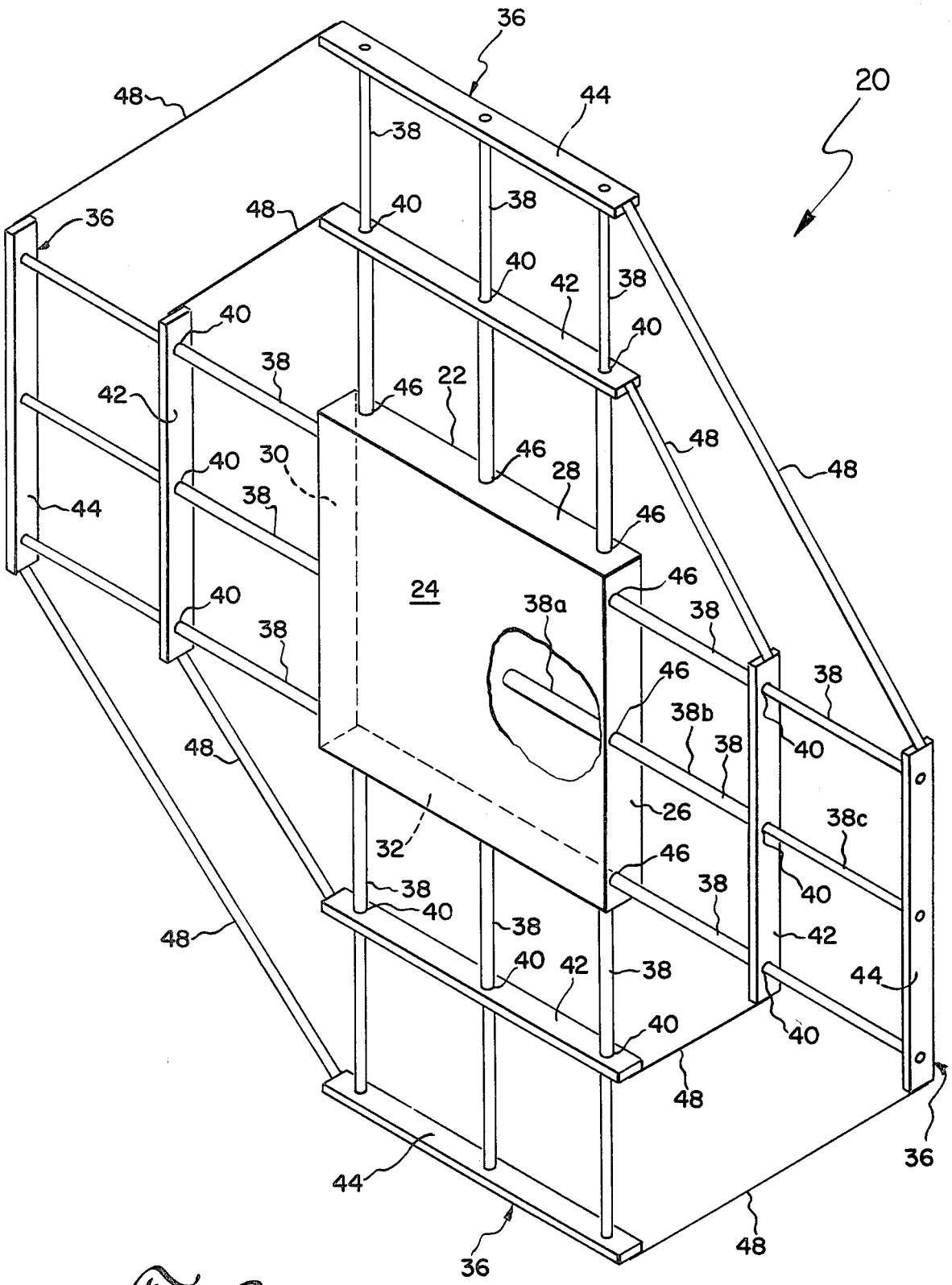
FIG. 6 is a perspective view of the antenna ground plane illustrating its essential features.

The antenna ground plane 20 appears most clearly in FIG. 6. It comprises a central base section 22, preferably of square configuration, which serves: as a mounting enclosure for components of the ground plane 20; as a mounting means for support structure 50 and expandable center post 80; and as an electrical connector mount for the helix 140, all as will be described more fully hereinafter. Desirably, base section 20 is made of a lightweight metal, such as aluminum, to facilitate portability of the antenna. Although illustrated as a solid faced enclosure, it will be appreciated that other configurations are also suitable and, particularly where they contribute to weight and/or wind resistance reduction, are desirable from a functional standpoint. Thus, for example, a ribbed construction having a perforated front plate would be entirely suitable. In its simplest form, base section 22 defines a partially open-backed enclosure including an electrically-active front surface 24 forming the center of ground plane 20, peripheral walls 26, 28, 30, 32 extending perpendicularly therefrom and a peripheral flange forming a partial rear surface 34. The rear surface 34 is not electrically active and is used, primarily, for mounting antenna support structure 50.

The major components of ground plane 20, in addition to base section 22, are four identical telescoping assemblies 36 shown in their fully extended configuration in FIG. 6. Each of the assemblies 36 consists of three substantially parallel multi-element telescoping rods 38 which pass through, in snug but sliding relationship with, spaced apertures 40 in metal intermediate support member 42 and have their ends firmly affixed in metal end support member 44. Desirably, each rod 38 comprises three concentric sliding tubes 38*a*, 38*b*, 38*c* arranged in telescoping relationship with the largest diameter tube 38*a* fixedly mounted within the base section 22. Tube 38*a* serves as a guide for the telescoping action of the other two successively reduced diameter tubes 38*b* and 38*c* which slide into and out of tube 38*a* and base section 22 through openings 46 formed in the base section peripheral walls 26, 28, 30, 32. There are twelve (12) telescoping rods sliding into and out of base section 22 and mechanical interference between these twelve rods within the base section is avoided by slightly offsetting the rods with respect to each other. The ground plane 20 is completed by connecting adjacent ends of the intermediate support members 42 and of the end support members 44 with flexible wire cables 48 which are permanently affixed thereto.

Figure 1:
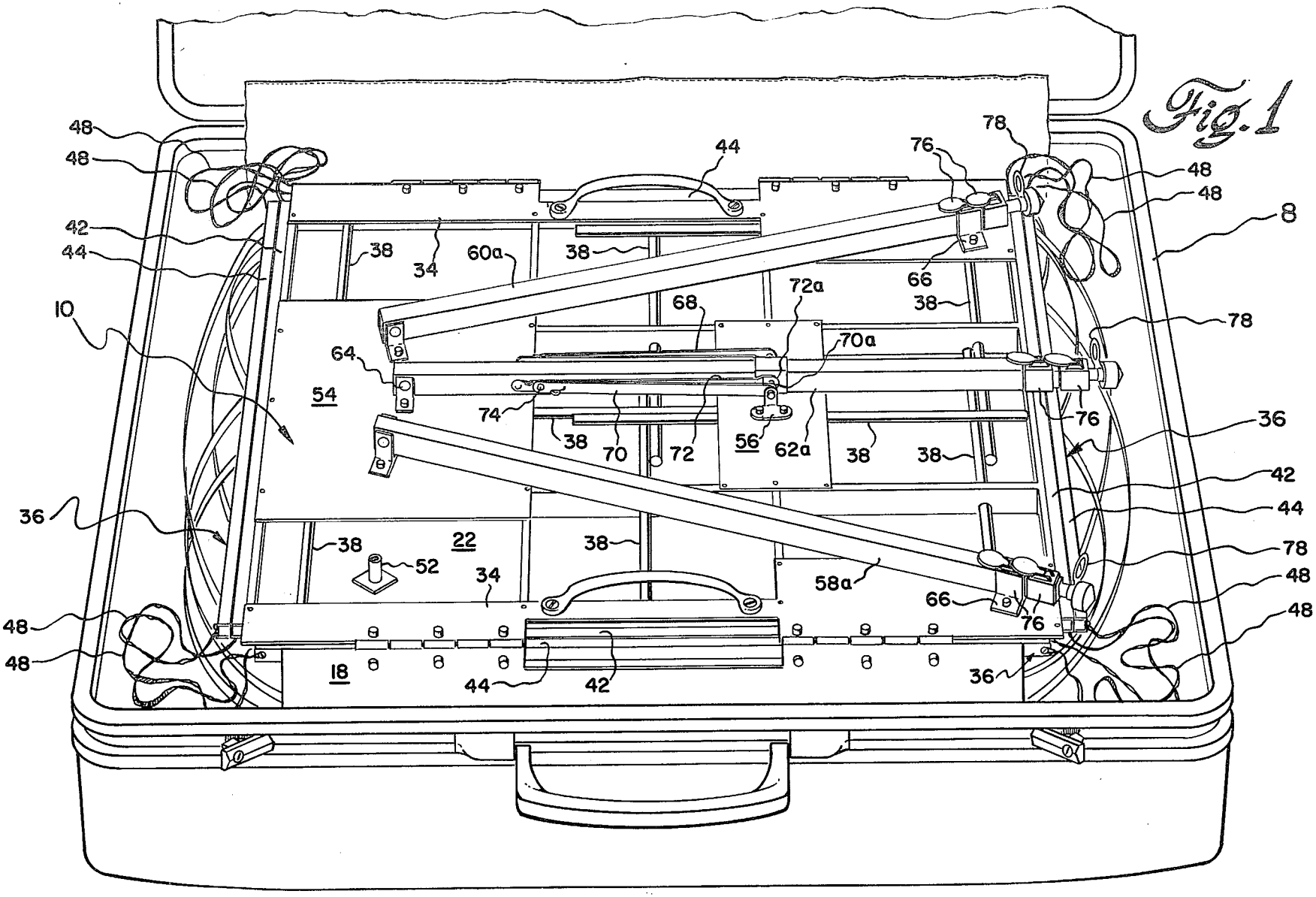
FIG. 1 is a perspective view of the antenna of the present invention fully collapsed and housed within a conventional suitcase.
Figure 3:
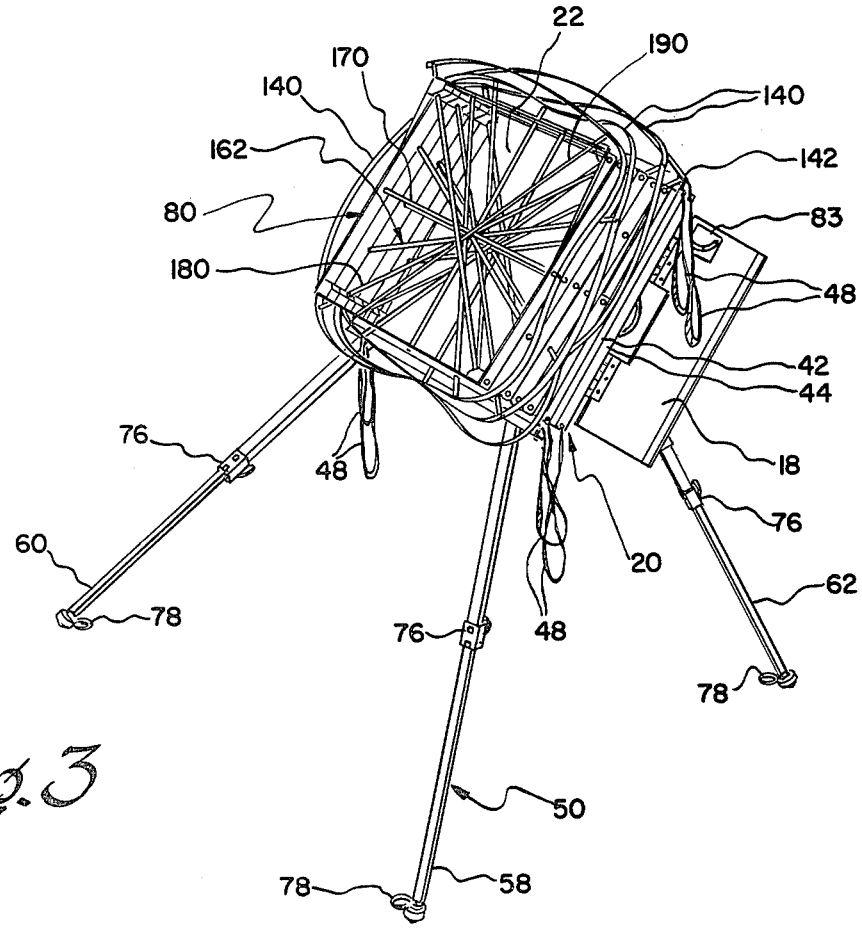
FIG. 3 is a perspective view of the antenna of the present invention in a partially collapsed condition illustrating the collapsed antenna conductive elements removed from the suitcase and supported by the antenna support structure.
Figure 4:
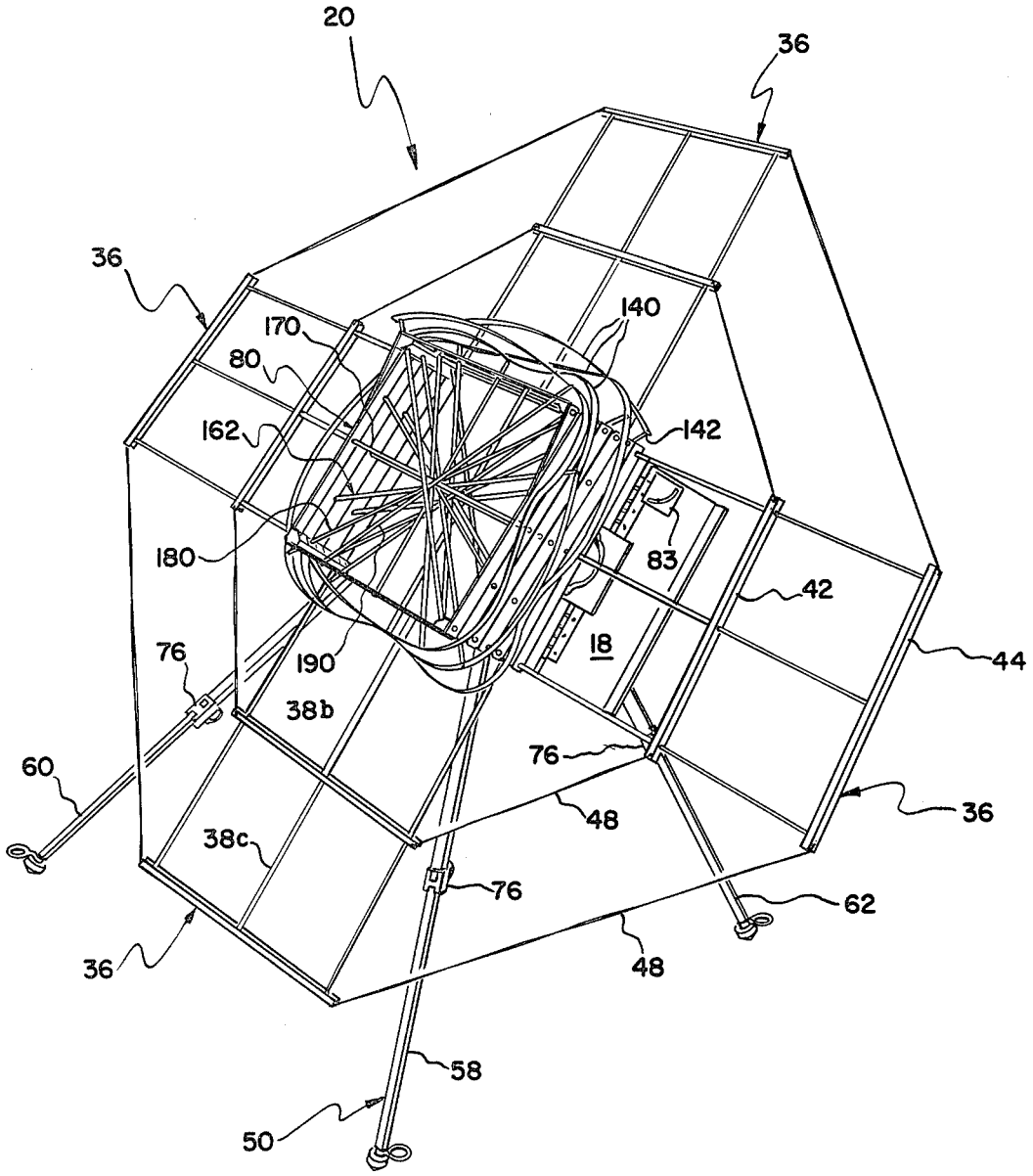
FIG. 4 is a perspective view of the antenna of the present invention in a partially collapsed condition illustrating the antenna ground plane in its unfolded configuration.

When extended, as shown in FIGS. 4, 5 and 6, the four telescoping assemblies 36 form the major area of the ground plane 20, the extended diameter of which should be approximately twice that of the helix section 140 of the antenna. This open structure acts electrically like a solid metal sheet as long as the spacing between conductors is small compared to the wavelength of the signal to be radiated or received. When collapsed, the total size of ground plane 20, as can be seen most clearly in FIG. 3, is the size of the base section 22 plus the thickness of support members 42 and 44. The eight wire cables 48 are easily folded out of the way and the entire antenna assembly readily fits into a large suitcase 8, as can be seen in FIG. 1.

An antenna support structure 50 (FIG. 2) is mounted on the rear surface 34 of base section 22, generally on bracket members 54, 56 supported by the peripheral rear flange, in conventional fashion. In its simplest form, antenna support structure 50 comprises three multi-element telescoping tripod legs 58, 60 and 62 and means for affixing the legs to the base section. For satellite communication applications, wherein the antenna will always be pointed upwardly at a considerable angle, outer legs 58 and 60 can, if desired, be fixedly mounted flush with the rear surface of the base section, for example, using conventional bracket means 66 to secure two points along each leg to the rear surface 34. Intermediate leg 62 is mounted via hinge means 64 at one end thereof to bracket 54 for up to 90° pivotal movement in a plane substantially perpendicular to the rear surface 34. A diagonal brace 68, comprising two elongated connecting sections 70 and 72 pivoted at adjacent ends about pivot pin 74, has the free end 70*a* of one section 70 hingedly mounted, in conventional manner, to bracket 56 on rear surface 34 and the free end 72*a* of the other section 72 affixed to leg element 62*a* a short distance from its hinged end for providing diagonal support for leg 62 when it is pivoted from a first position flush with rear surface 34 to a second position wherein it forms, with legs 58 and 60, a supporting tripod for antenna 10. The multi-element telescoping legs 58, 60, 62 are adjustable in length in conventional fashion and include a plurality of clamping blocks 76 along their lengths to secure the elements of each leg at any desired length.

Figure 2:
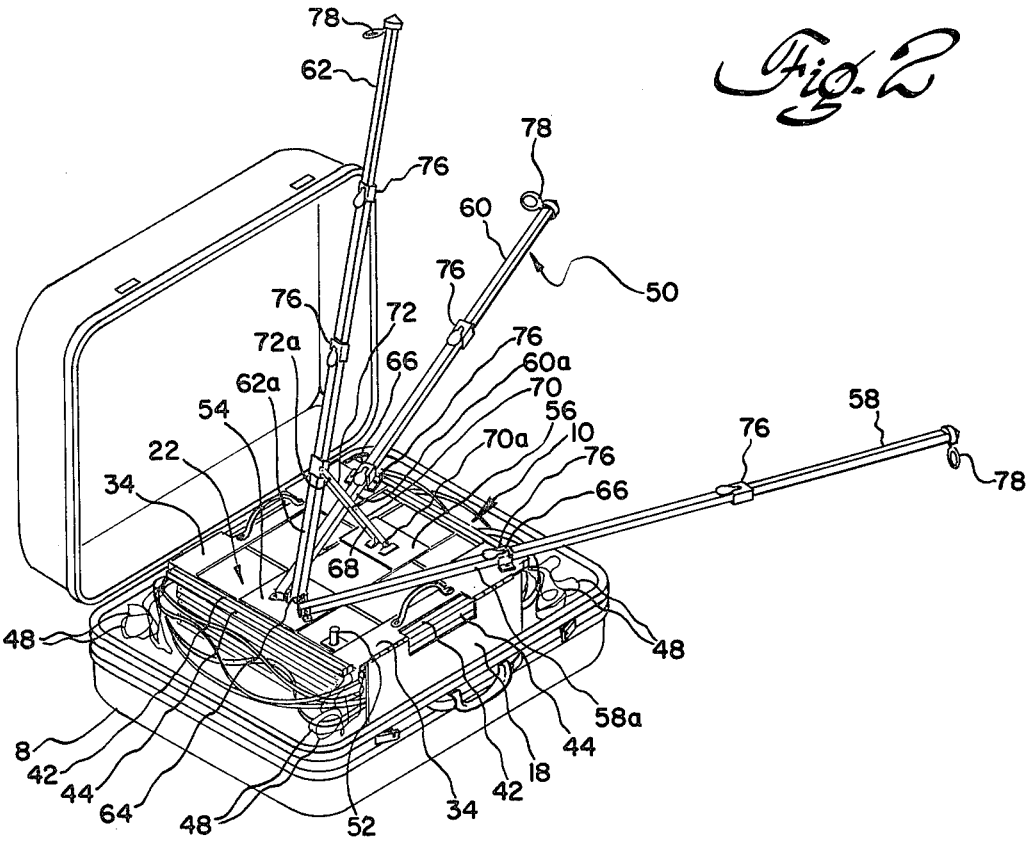
FIG. 2 is a perspective view of the antenna of the present invention in a partially collapsed condition illustrating the antenna support structure in its unfolded configuration.

Typically, as shown in FIG. 2, legs 58, 60 are telescoped in their extended positions to the same length and leg 62 is pivoted to unfold brace 68 and form the desired support tripod. The length of leg 62 is adjusted to provide the desired elevation angle for antenna 10 as indicated on an inclinometer 83. The tripod support structure can be anchored in position by driving stakes (not shown) through stake rings 78 affixed to legs 58, 60, 62 at the ends thereof which contact the ground. When collapsed, legs 58 and 60 are telescopingly retracted into the largest diameter leg element 58*a* and 60*a*, respectively. Diagonal brace 68 is folded by pivoting sections 70 and 72 about pivot pin 74 until they are side-by-side and pivoting leg 62 about hinge means 64 to a position flush with rear surface 34. Leg 62 is then telescopingly retracted into the largest diameter leg element 62*a*. As can be seen most clearly in FIG. 1, when collapsed, leg elements 58*a*, 60*a*, 62*a* are positioned flush with rear surface 34 and are approximately the length of base section 22 such that when the antenna 10 is inserted into suitcase 8, the tripod legs are substantially aligned with the long suitcase dimension.

Figure 7:
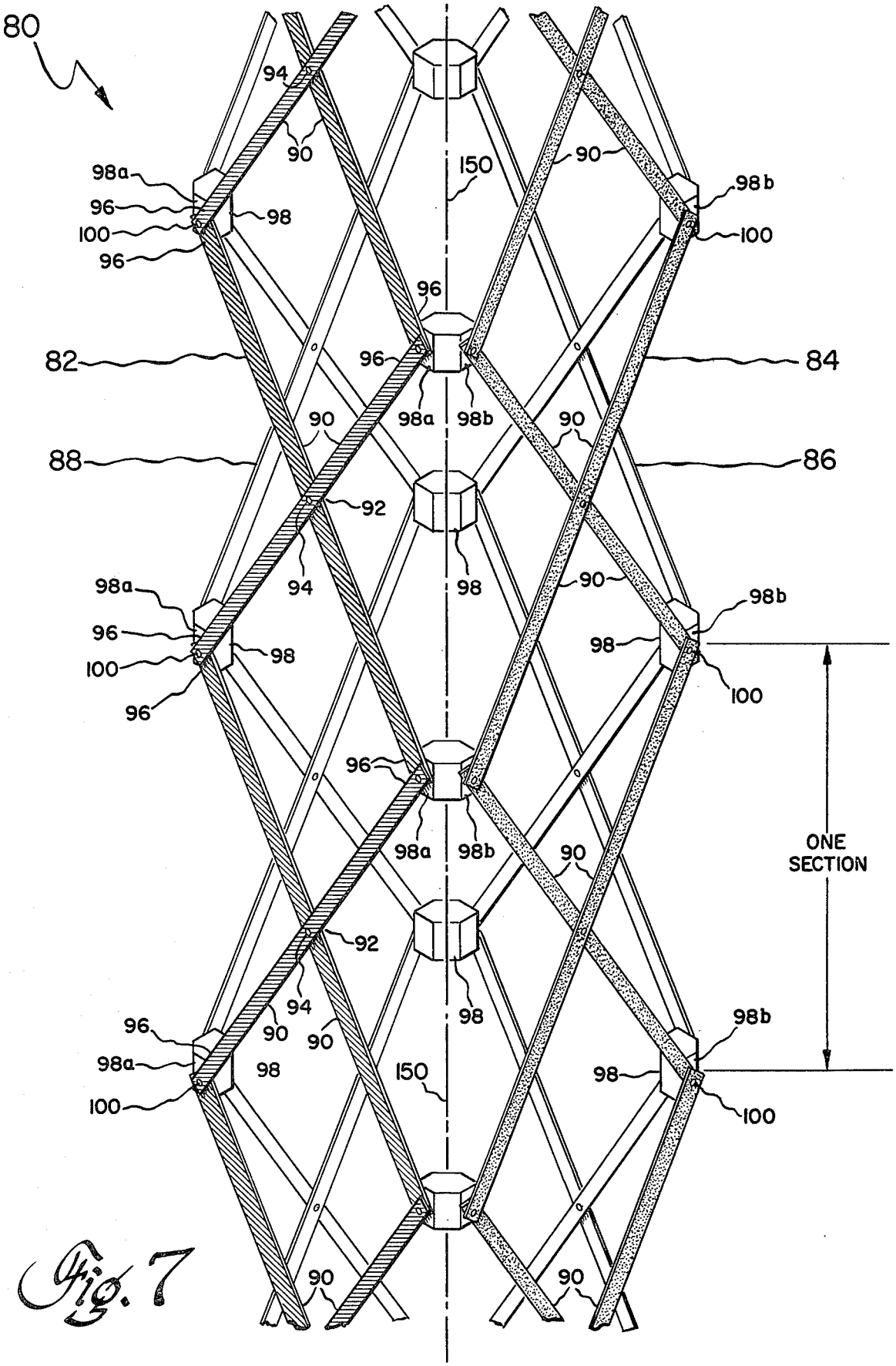
FIG. 7 is a perspective view of a portion of the expandable center post of the antenna illustrating its essential features.

Expandable center post 80 is the primary center support for helix 140 and is most clearly illustrated in FIG. 7 which shows a portion thereof. Post 80 is a square assembly having four sides 82, 84, 86, 88, each side being identical to the other sides and consisting of an expandable and collapsible criss-cross structure similar to that of the well-known lazy tong structure and/or of the conventional expanding stairway gate. A first side 82 (the members of which are shown having diagonal markings) consists of a plurality of pairs of criss-crossed members 90 joined and pivoted together at their centers at 92 by a pivot pin 94 extending through the crossed members and joined and pivoted at their ends at 96 where the overlapping ends of members 90 are supported on surface 98*a* of square pivot block 98 by a pivot pin 100 extending through the overlapped members and into the pivot block 98. A second side 84 (the members of which are shown having cross-hatched markings) is arranged generally perpendicular to first side 82 with the ends of the overlapped members 90 joined and pivoted together with a pivot pin 100 extending through the members and into a surface 98*b* of pivot block 98 which is perpendicular to surface 98*a* of pivot block 98. In the same manner a third side 86 is arranged perpendicularly to the second side 84 and parallel to first side 82 and a fourth side 88 is arranged perpendicularly to third side 86 and parallel to second side 84 to form post 80 as an expandable and collapsible structure having a square cross-section and consisting of a plurality of end-to-end arranged post sections wherein a post-section, as shown in FIG. 7, comprises a portion of post 80 between axially-spaced-apart parallel planes arranged normal to post axis 150, with each plane passing through pivot pins 100 of adjacent sets of four pivot blocks 98. Although the expandable center post 80 is described herein as four sided, it could have three or more sides and function equally well. However, a four-sided post affords symmetry with ground plane 20 and has advantages for mounting the helix support rods, as will be described hereinafter. For these reasons, the four-sided expandable post is preferred.

It will be appreciated that one end of post 80 is mounted, in a manner to be described hereinafter, upon electrically active front surface 24 of base section 22 and that post 80 may be made as long as is desired by the addition of criss-crossed members 90 and pivot blocks 98 in the manner already described. It will further be appreciated that with one end of post 80 fixed, the cross-sectional dimensions of the square post will decrease as the post is expanded, i.e., opposite side pairs 82, 86 and 84, 88 will be drawn closer together, and the cross-sectional dimensions of the square post will increase as the post is collapsed toward base section 22, i.e, opposite side pairs 82, 86 and 84, 88 will be forced further apart. Inasmuch as post 80 is within the antenna field, all members of the structure, i.e., members 90, pivot blocks 98 and pivot pins 100, should be formed of non-metallic material.

Figure 8:
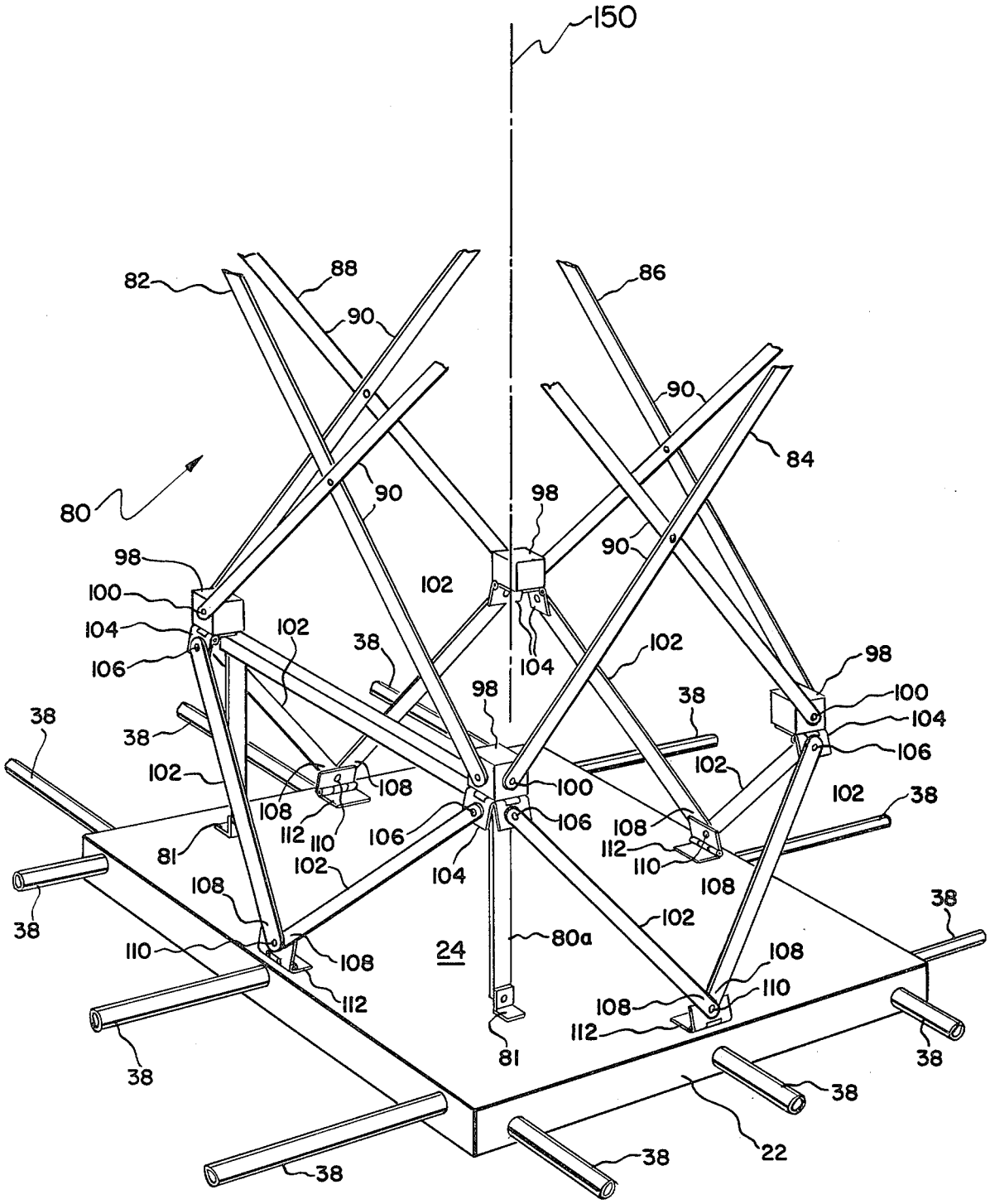
FIG. 8 is a perspective view of the means for mounting the expandable center post to the antenna ground plane.

As has previously been indicated, expandable post 80 is mounted on base section 22 and is expandable and collapsible in a direction substantially normal to surface 24. When fully collapsed, as in FIG. 3, post 80 forms a compact stacked structure having a square cross section of about the same dimensions as surface 24 and having a height above surface 24 approximately equal to the height of each stack of pivot blocks 98 which neatly form into four columns on surface 24. The pivot block columns define the four corners of the collapsed square post and the stacked members 90, with pivot pins 94 aligned, define the sides of the collapsed square post. This compact collapsed arrangement enhances the portability of the antenna of the present invention and is made possible by the unique means by which expandable post 80 is mounted onto surface 24 of base section 22, as can be seen most clearly in FIG. 8. Eight half-length mounting members 102, are pivotally joined to eight block mounting hinges 104 of the four pivot blocks 98 of post 80 most closely adjacent to base section 22. Pivot pins 106 extend through one end of mounting member 102 and through the pivoting portion of block mounting hinges 104. The mounting members 102 extend toward base section 22 in conventional criss-cross fashion. However, due to their half length they are joined and pivoted at their ends at 108 by pivot pins 110 extending through the overlapping ends of mounting members 102 and through the pivoting portions of base mounting hinges 112 which are affixed to and located on surface 24, preferably in alignment with pivot pins 94 when post 80 is fully collapsed. The block mounting hinges 104 and base mounting hinges 112 are arranged and oriented in a manner to accomodate, by pivoting, the change in cross-sectional dimension of post 80 as it expands (cross-section diminishes) and collapses (cross-section increases). In the preferred arrangement illustrated in FIG. 8, when post 80 is fully collapsed, hinges 104 and 112 allow mounting members 102 to collapse to a configuration wherein members 102, and pivot blocks 98 to which they are hinged, are substantially flush with surface 24 and mounting members 102 are in alignment with members 90 to define the collapsed, stacked, maximum-dimension square cross-section of post 80. As post 80 is expanded, base mounting hinges 112 pivot inwardly toward the center of base section 22, i.e., toward axis 150 of post 80, to accommodate the decreased post cross-section which results from expansion. When post 80 is expanded, the four-point hinged mounting to base section 22, as assisted by a somewhat U-shaped locking bar 80*a*(pivotally mounted at 81 to surface 24) bearing against two of the pivot blocks 98, insures that expandable post 80 is completely rigid and remains substantially perpendicular to surface 24 of base section 22.

Helix element 140, as can best be seen in FIG. 5, is a metal spiral wound around expandable post 80 for the required number of turns and supported on post 80 by helix support system 160. Metal helix 140 has a much larger diameter than the maximum cross-sectional dimension of expanded post 80. However, as will be seen from the following description, due to the flexible nature of the metal tape comprising the helix material, the larger dimensions present no serious problem in terms of the compactness or portability of the collapsed antenna. Helix 140 is electrically connected to a coaxial transmission cable connector 142, where the antenna helix spirals down to meet ground plane 20. An impedance-matching network is desirable for a good 50 ohm match to the line.

Helix 140 is supported on expandable post 80 by helix support system 160 which comprises a plurality of support rods 162 arranged to slide generally radially outwardly and inwardly relative to the perimeter of post 80 to expand helix 140 radially outwardly relative to longitudinal axis 150 as post 80 is expanded and to retract helix 140 radially inwardly as post 80 is collapsed. In this manner, since helix 140 is a continuous metal tape supported by and affixed to the outermost ends of support rods 162, the helix diameter increases as the post is expanded and decreases as the post is collapsed. When post 80 is fully collapsed, as can be seen in FIG. 3, helix 140 can readily be loosely wound about the collapsed post and will fit within any compact package in which the antenna may be placed for transport.

The helix support rods 162 are formed of a dielectric material, such as fiberglass rods, and each is supported along its length at two points on post 80. Each rod 162 passes through post 80 and has one end portion extending substantially radially outwardly of post 80 relative to axis 150 to project beyond the perimeter of post 80 and support and connect to helix 140 at its extended end. The opposite end of rod 162, remote from the helix connection) is substantially fixed relative to expandable post 80, although this opposite end may be slidable along its end portion within fixed limits. In the preferred form of the present invention, the helix support rods pass through the axis 150 of expandable post 80 and are supported by post 80 at some of the pivot blocks 98, at some of the crisscross pivot points 92 of members 90 and at some points intermediate the ends of members 90, desirably at points located about one-quarter of the distance between pivot blocks. FIG. 9 illustrates an end view of expandable post 80 looking toward base section 22, to show an exemplary support rod orientation relative to members 90 and pivot blocks 98 of square cross-section post 80 for supporting helix 140 in an expanded configuration.

As can be most clearly seen in FIGS. 5 and 9, a first support rod 170 is mounted on post 80 for support at criss-cross points 92 on opposite sides 84, 88 of post 80, such that rod 170 passes substantially normal to and through axis 150. End 172 remote from helix 140 is fixed in position by pins 176, 178 at the support point 92 on side 88; the pins prevent sliding movement of the end. End 174 extends through support point 92 on side 84 and connects to helix 140. Rod 170 is slidable at the support point on side 84 between inner and outer limits defined, respectively, by pin 179 and helix 140.

A second support rod 180 is mounted on post 80 for support at diagonally opposite pivot blocks 98, which are located in a plane passing substantially normal to and through axis 150. End 182 remote from helix 140 is slidable, in support pivot block 98, along its end portion between inner and outer limits defined by pins 185 and 186, respectively. End 184 extends through its supporting pivot block to connect to helix 140 and is slidable, in its pivot block 98, along its end portion between inner and outer limits defined by pins 187 and 188, respectively.

A third support rod 190 is mounted on post 80 for support at points 93, 95, each located on a member 90 (forming a part of opposite sides 82, 86 of post 80) at a distance one-quarter of the length of such member 90 from sides 88 and 84, respectively, such that rod 190 passes through axis 150. End 192 remote from helix 140 is slidable, at point 93 and through support member 90, along its end portion between inner and outer limits defined by pins 195 and 196, respectively. End 194 extends through member 90 at support point 95 to connect to helix 140 and is slidable along its end portion at support point 95, between inner and outer limits defined, respectively, by pins 197 and 198.

The foregoing arrangement of support rods provides for helix support every 3/16 of a turn and provides ¾ of a turn for every section of expandable post; other arrangements can be equally as well utilized.

It will be appreciated, as previously discussed herein, that as post 80 expands there is a reduction in cross section, with the result that opposite side pairs 82, 86 and 84, 88 are drawn closer together. When this occurs, end 174 of rod 170 slides through its support at 92 until pin 179 provides a stop to limit helix expansion. In similar manner, rod 180 slides through its support blocks until pins 185 and 187 provide stops to limit helix expansion. Rod 190 also slides through support points 93, 95 until pins 195 and 197 provide stops to limit helix expansion. In this manner, when collapsible antenna 10 is removed from its transportable package and erected, it is a simple manner to expand post 80 away from base section 22 until the design expansion point for helix 140 is reached. It will be further appreciated that as post 80 collapses there is an increase in cross section, with the result that opposite side pairs 82, 86 and 84, 88 are forced further apart. When this occurs, end 174 of rod 170 and both ends of rods 180 and 190 slide in their respective supports until pins 186, 188 and 196, 198 provide stops to limit the collapse of helix 140 (see FIG. 10) and to prevent the helix from retracting inside expandable post 80 as it collapses.

Antenna 10 of the present invention is readily collapsible and erectable. The illustrated embodiment is designed for satellite communication at frequencies in the 136 MHz. range; even at this relatively long wavelength (for satellite communication purposes), the antenna is of a size which, when collapsed, easily fits within a large suitcase which can be transported by an average-size person. Antenna 10 in fully collapsed configuration and housed within such a suitcase 8 is illustrated in FIG. 1. It will be noted that the antenna 10 is placed within suitcase 8 with expandable post 80 and helix 140 facing the inside bottom of the suitcase and with rear surface 34 of base section 22 facing upwardly as the case is opened for immediate access to telescoping tripod legs 58, 60, 62. In this manner, as can be seen from FIG. 2, antenna support structure 50 can be erected first, even while the antenna remains in the suitcase. This is readily accomplished by telescoping legs 58, 60 to their full length, pivoting leg 62 to unfold brace 68 and telescoping leg 62 to desired length (which may later be adjusted to provide the desired elevation angle for the antenna) in order to provide a tripod support structure for supporting the antenna on the ground. The antenna 10 may be removed from suitcase 8 and supported upon the tripod structure. Protective side panels 18 (which are hinged to rear surface 34 of base section 22 to enclose collapsed post 80 during transportion) are pivoted rearwardly to expose, as shown in FIG. 3, support members 42 and 44, collapsed center post 80 and flexible metal tape helix 140 loosely draped around the collapsed center post 80. Ground plane 20 is extended, as shown in FIG. 4, by pulling support members 42, 44 outwardly from base section 22 to extend telescoping assemblies 36 to form the open structure comprising the ground plane 20. Expandable center post 80 is expanded outwardly from base section 22 to support and expand helix support system 160 and to erect helix 140 about expanded post 80 as is shown in FIG. 5. In this configuration, antenna 10 is fully erected and the coaxial cable may be connected from a communications transceiver to connector 52 on rear surface 34.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed is:

1. A collapsible, portable, unitary antenna, comprising:

a substantially planar and electrically-conductive first portion including: (1) an electrically-conductive base element; (2) at least one electrically-conductive assembly collapsibly mounted to said base element and including an electrically-conductive perimeter-defining element movable substantially in the plane of said first portion between a collapsed position adjacent to said base element and an expanded position spaced from said base element; and (3) means for collapsibly mounting said perimeter-defining element to said base element;

a generally elongatable, electrically-conductive second portion retractably extending substantially normal to the plane of said first conductive portion; and means for collapsibly supporting said second conductive portion on said first conductive portion.

2. The antenna of claim 1, wherein said collapsible mounting means comprises at least one elongated electrically-conductive telescoping support for guiding movement of said perimeter-defining element between its collapsed and expanded positions.

3. The antenna of claim 2, wherein said collapsible mounting means comprises a plurality of said telescoping supports and includes at least one electrically-conductive member supporting said telescoping supports between said base element and said perimeter-defining element in its expanded position, said member being movable between a collapsed position adjacent to said base element and spacing said permimeter-defining element from said base element and an expanded position intermediate said base element and said perimeter-defining element.

4. The antenna of claim 3, wherein said base element comprises a housing and each of said telescoping supports comprises a series of concentrically engaged multi-segment telescoping rods, a largest diameter segment of each rod being mounted at least partly within said housing for guiding the collapsing and expanding of said telescoping rods.

5. The antenna of claims 1, 2, 3 or 4, wherein said first conductive portion includes a plurality of electrically-conductive collapsible assemblies uniformly spaced around said base element, each said assembly being electrically connected to each adjacent assembly.

6. The antenna of claim 5, wherein said first conductive portion includes flexible conductor means for electrically connecting said assemblies through their respective perimeter-defining elements.

7. The antenna of claim 6, wherein said base element is square and four assemblies are uniformly spaced therearound.

8. The antenna of claims 3 or 4, wherein said first conductive portion includes a plurality of electrically-conductive collapsible assemblies uniformly spaced around said base element and flexible conductor means for electrically connecting said assemblies to adjacent assemblies through their respective perimeter-defining elements and their respective supporting members.

9. The antenna of claim 7, wherein said base element is square and four assemblies are uniformly spaced therearound.

10. The antenna of claims 1, 2, 3 or 4, wherein said collapsibly supporting means comprises:

an at-least-three-sided elongated frame structure having one end thereof movable respectively toward and away from said first conductive portion between collapsed and expanded frame structure positions, respectively;

means mounting the other end of said frame structure to said first conductive portion; and means mounting said second conductive portion to said frame structure for extending said second conductive portion when said frame structure is expanded and for retracting said second conductive portion when said frame structure is collapsed.

11. The antenna of claim 10, wherein said first conductive portion includes a plurality of electrically-conductive collapsible assemblies uniformly spaced around said base element, each said assembly being electrically connected to each adjacent assembly.

12. The antenna of claim 11, wherein said first conductive portion includes flexible conductor means for electrically connecting said assemblies through their respective perimeter-defining elements.

13. The antenna of claim 12, wherein said frame structure comprises at least three pivotally interconnected, relatively movable sides, each said side comprising a plurality of pivotally interconnected, relatively movable frame sections, each said frame section comprises a pair of pivotally interconnected, relatively movable frame members, with movement of said one end toward and away from said base element causing pivotal movement of said frame members and sections and accordion-like collapse and expansion, respectively, of said frame structure; and wherein said means mounting said second conductive portion to said frame structure comprises a plurality of elongated rods mounted on said frame structure, one end portion of each said rod projecting outwardly from the perimeter of said frame structure and affixed to said second conductive portion, said one end portion being slidable away from and toward said frame structure for extending and retracting said second conductive portion as said frame structure moves between expanded and collapsed portions.

14. The antenna of claim 13, wherein said base element is square and four assemblies are uniformly spaced therearound and said frame structure has four sides.

15. The antenna of claim 14, wherein said second conductive portion comprises a metal helix spirally wound about the longitudinal extent of said frame structure.

16. The antenna of claim 13, wherein said second conductive portion comprises a metal helix spirally wound about the longitudinal extent of said frame structure.

17. The antenna of claim 10, wherein said second conductive portion comprises a metal helix spirally wound about the longitudinal extent of said frame structure.

18. A collapsible, portable, unitary antenna, comprising:

a substantially planar and electrically-conductive first portion;

a generally elongatable, electrically-conductive second portion retractably extending substantially normal to the plane of said first conductive portion; and means for collapsibly supporting said second conductive portion on said first conductive portion and comprising:

an at-least-three-sided elongated frame structure having one end thereof movable respectively toward and away from said first conductive portion between collapsed and expanded frame structure positions, respectively;

means for pivotally mounting the other end of said frame structure to said first conductive portion; and means slidingly mounting said second conductive portion to said frame structure for extending said second conductive portion when said frame structure is expanded and for retracting said second conductive portion when said frame structure is collapsed.

19. The antenna of claim 18, wherein said frame structure comprises at least three pivotally interconnected, relatively movable sides.

20. The antenna of claim 19, wherein each said side comprises at least one pivotally interconnected, relatively movable frame section.

21. The antenna of claim 20, wherein each frame section comprises a pair of pivotally interconnected, relatively movable frame members, with movement of said one end toward and away from said first conductive portion causing pivotal movement of said frame members and frame sections and accordion-like collapse and expansion, respectively, of said frame structure.

22. The antenna of claim 21, wherein said frame structure has at least four sides, and said means mounting said second conductive portion to said frame structure comprises a plurality of elongated rods mounted on said frame structure, each said rod being supported at an end portion by a frame member on each of two nonadjacent sides of said frame structure, said nonadjacent sides being movable toward and away from each other as said frame structure moves between expanded and collapsed portions, one end portion of each said rod being substantially fixed in position relative to its supporting frame member, the opposite end portion of each said rod projecting outwardly from the perimeter of said frame structure and affixed to said second conductive portion, said opposite end portion being slidable relative to its supporting frame member away from and towards said frame structure for extending and retracting said second conductive portion as said frame structure moves between expanded and collapsed positions.

23. The antenna of claim 22, wherein said means mounting the other end of said frame structure to said first conductive portion comprises: first hinge means mounted on said first conductive portion for pivotal movement toward and away from the longitudinal axis of said second conductive portion; second hinge means supported by the frame section on each side of said frame structure immediately adjacent to said first conductive portion; and a plurality of end frame members connected between said first and second hinge means for pivotal movement of said end frame members for orienting said end frame members substantially flush with the plane of said first conductive portion and in stacked alignment with said frame members when said frame structure moves to the collapsed position.

24. The antenna of claims 18, 19, 20 or 21, wherein said means mounting said second conductive portion to said frame structure comprises a plurality of elongated rods mounted on said frame structure, one end portion of each said rod projecting outwardly from the perimeter of said frame structure and affixed to said second conductive portion, said one end portion being slidable away from and toward said frame structure for extending and retracting said second conductive portion as said frame structure moves between expanded and collapsed positions.

25. The antenna of claim 24, wherein said frame structure has at least four sides.

* * * * *